US006481813B1

(12) United States Patent
Müterthies et al.

(10) Patent No.: US 6,481,813 B1
(45) Date of Patent: Nov. 19, 2002

(54) FASTENING ARRANGEMENT

(75) Inventors: Ralf Müterthies, Löhne (DE); Stefan Rüter, Bad Oeynhausen (DE); Carsten Meyer, Bielefeld (DE); Gerhard Schröder, Bad Oeynhausen (DE); Jörg Aufderheide, Spenge (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 0 days.

(21) Appl. No.: 09/663,190

(22) Filed: Sep. 15, 2000

(30) Foreign Application Priority Data

Sep. 17, 1999 (DE) ..... 199 44 638

(51) Int. Cl.[7] ..... A47B 88/00
(52) U.S. Cl. ..... 312/348.1; 312/330.1
(58) Field of Search ..... 312/330.1, 334.1, 312/334.8, 334.14, 348.1, 348.2, 348.4

(56) References Cited

U.S. PATENT DOCUMENTS

| | | | | |
|---|---|---|---|---|
| 3,029,357 A | | 4/1962 | Williams | 312/263 |
| 3,462,208 A | * | 8/1969 | Black et al. | 312/330.1 X |
| 3,549,301 A | | 12/1970 | Harris et al. | 312/330.1 |
| 3,729,246 A | | 4/1973 | Harrell et al. | 312/330.1 |
| 3,759,600 A | * | 9/1973 | MacDonald | 312/348.1 |
| 5,197,791 A | | 3/1993 | Domenig | 312/348.1 |
| 5,370,454 A | | 12/1994 | Domenig | 312/348.1 |
| 5,433,518 A | | 7/1995 | Skov | 312/348.1 |
| 5,682,936 A | * | 11/1997 | Higdon, Jr. | 312/348.1 X |
| 5,743,608 A | * | 4/1998 | Johannes | 312/330.1 X |
| 5,971,516 A | * | 10/1999 | Huber | 312/348.1 |

FOREIGN PATENT DOCUMENTS

| | | | |
|---|---|---|---|
| CH | 658171 | * 10/1986 | 312/348.1 |
| DE | 73 17 344.1 | 5/1973 | |
| DE | 79 00 396 | 6/1980 | |
| DE | 83 33 251.0 | 3/1984 | |
| DE | 40 16 452 A1 | 9/1991 | |
| DE | 93 11 493.1 | 11/1993 | |
| DE | 94 07 813.0 | 9/1994 | |
| DE | 19726466 A1 | 12/1998 | |

* cited by examiner

*Primary Examiner*—James O. Hansen
(74) *Attorney, Agent, or Firm*—Barnes & Thornburg

(57) ABSTRACT

A fastening arrangement used for fastening a rear-side wall element of a drawer to a sliding drawer bottom. The arrangement includes a connection element and a wall element which is fixed on the sliding bottom, and a connection element which can be mounted on the sliding bottom and connected with a pull-out slide. The wall element is pivotally connected on the sliding bottom. A catch device formed on the connection element holds the wall element in a mounting position. Preferably, an attachment on the connection element has a recess and a stop for the wall element. This construction simplifies the mounting of a drawer and reduces the manufacturing, costs because only a small number of components are required.

12 Claims, 10 Drawing Sheets

FASTENING ARRANGEMENT

BACKGROUND AND SUMMARY OF THE INVENTION

The invention relates to a fastening arrangement used for fastening a rear-side wall element of a drawer to a sliding bottom and a connection element.

Filed contemporaneously herewith are six United States patent applications, commonly assigned to Paul Hettich GmbH & Co.:

| INVENTOR(S) | TITLE | SERIAL NO. |
|---|---|---|
| Müterthies, Rüter, et al. | Fastening Arrangement | 09/663,187 |
| Müterthies, Rüter, et al. | Fastening Arrangement | 09/663,188 |
| Müterthies, Rüter, et al. | Mounting Unit | 09/663,182 |
| Müterthies, Rüter, et al. | Pull-out Slide Set | 09/663,189 |
| Müterthies, Rüter, et al. | Partitioning System | 09/663,186 |
| Müterthies, Rüter, et al. | Fastening Arrangement | 09/663,181 |

The claims, drawings and specification of each of the foregoing applications is hereby specifically incorporated by reference into this specification as if set forth verbatim herein German Patent Document DE 197 26 466 A1 a fastening arrangement shows a rear wall of a drawer which can be connected with a side wall of the drawer using a corner connector. The side wall of the drawer, in turn, is connected with a slide rail of a pull-out slide using a profile rail. The profile rail has a bendable or hinge-type construction so that the drawer side wall can be folded into a position parallel to the drawer bottom. Although the sliding bottom and the side walls can be stored and transported relatively well, the mounting of the rear wall requires relatively high expenditures. First, a corner connector must be screwed to a projection on the profile rail and additionally be fitted into the side wall. Subsequently, the rear wall is mounted on the corner connector by means of additional fastening devices. In addition to the high mounting expenditures, this construction requires a large number of components, which increases the manufacturing costs. In addition, the corner connector is adapted specifically to the respective side walls and rear walls and can therefore not easily be used for drawers of other sizes.

It is therefore an object of the present invention to provide a fastening arrangement for a wall element which can be mounted as easily as possible and has only few components. In addition, the fastening arrangement should be usable with drawers and sliding bottoms of different constructions.

According to the invention, a fastening arrangement is provided to fasten a wall element on a sliding bottom and a connection element. The arrangement includes a connection element which is fixed at the sliding bottom, and another connection element mounted on the sliding bottom and which can be connected with a pull-out slide. The wall element is pivotally connected to the sliding bottom, and a catch device holds the wall element in a mounting position. This construction of the fastening arrangement permits a simple and fast mounting of the wall element which must only be pivoted to the upright mounting position and must be locked at the catch device. The catching sound signals that the desired mounting position has been reached. In addition, the necessity of a separate corner connector for the wall element is eliminated, which also reduces the manufacturing costs.

According to a preferred embodiment of the invention, the connection element is also pivotally connected, and includes a part of the catch device which engages the other part of the catch device in the mounting position. During the mounting, the catch device determines whether the connection element or the wall element is in the mounting position. Because a catch device can usually be released in one direction, the sequence of the folding-up can be determined according to the direction in which a higher stress is to be expected. Should stress occur in several directions, it is also possible to lock the catch device or the wall element.

If the wall element is to be formed by bending upward from the sliding bottom, it can be preassembled in a simple manner on the sliding bottom in order to then be bent into the mounting position. Also, no additional hinge elements are required.

A particularly diverse use of the connection element is made possible when a holding structure is used as a stop for the wall element in the mounting position. Additionally, holding elements to fasten side or front wall attachments may be added to a plastic holding structure in order to increase the height. The holding structure permits a multiple use of the connection element. An attachment is preferably provided on the holding structure. The attachment has a recess and the stop for the wall element. A stable and inexpensive fastening arrangement is obtained if the attachment is made of plastic and cast onto a metal section connected with the pull-out slide.

If the wall element has a bend on a lateral edge of the sliding bottom, the lateral edge can be used as a rest in order to bring the wall element into an essentially vertical mounting position. This reduces the stress on the material in the area of the bend. Preferably oblong openings are near the bending point to prevent unintentional bending of the wall during mounting.

According to a preferred embodiment, the wall is curved along its upper edge. A recess is formed on the curve, and adjacent to the recess is a catch tongue. This design permits a manufacturing of the wall element at reasonable cost from a metal sheet, on which only the necessary punchings and bends must be provided. In addition, the catch tongue engages the recess when in the mounted position.

A particularly high side and rear wall can be produced if the attachment is constructed in several parts and includes an upper part having a catch device. The mounting of an additional attachment part enables the attachment to be easily adapted to different types and heights of drawers.

Furthermore, according to the invention, a drawer is provided which has a sliding bottom held on both sides on one pull-out slide respectively, a front panel, a side wall and a rear wall, in which case the rear wall is held by means of two fastening arrangement according to one of the preceding claims.

In the following, the invention will be explained in detail including several embodiments with reference to the attached drawings.

DETAILED DESCRIPTION OF PREFERRED EMBODIMENTS

Figure 1:
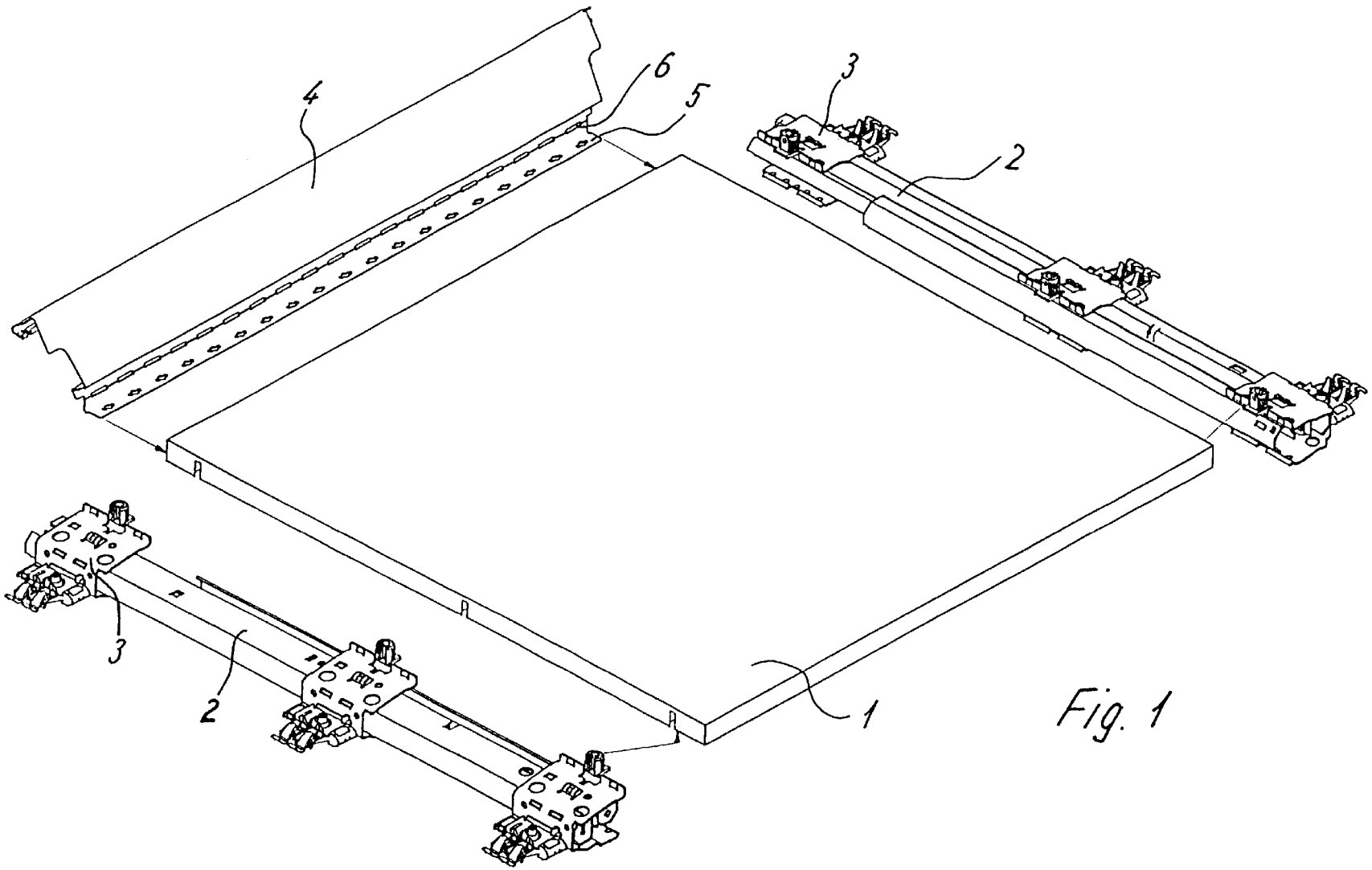
FIG. 1 is a perspective exploded view of a first embodiment of a fastening arrangement according to the invention which has a sliding bottom.
Figure 2:
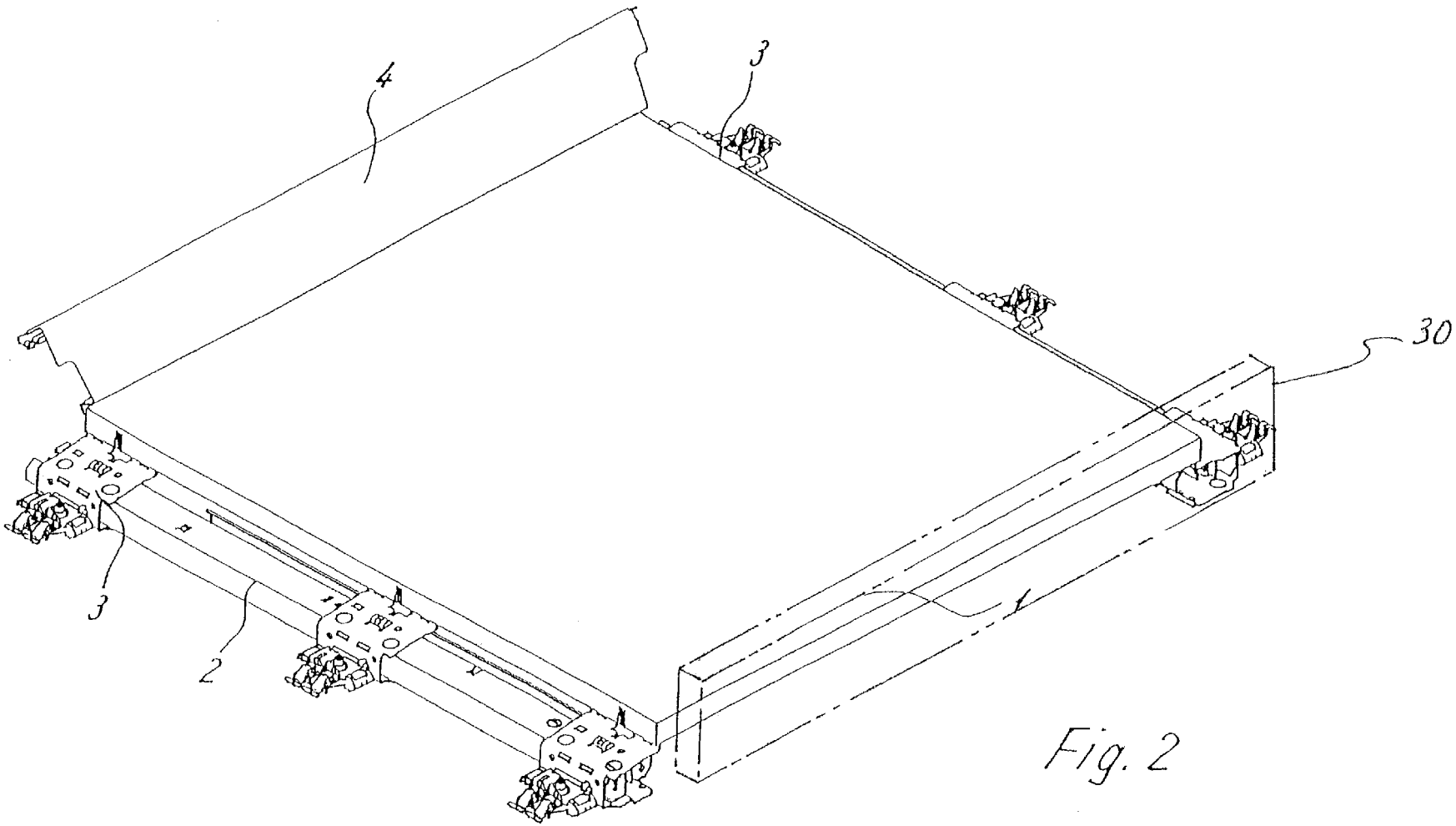
FIG. 2 is a perspective view of the fastening arrangement of FIG. 1.
Figure 3:
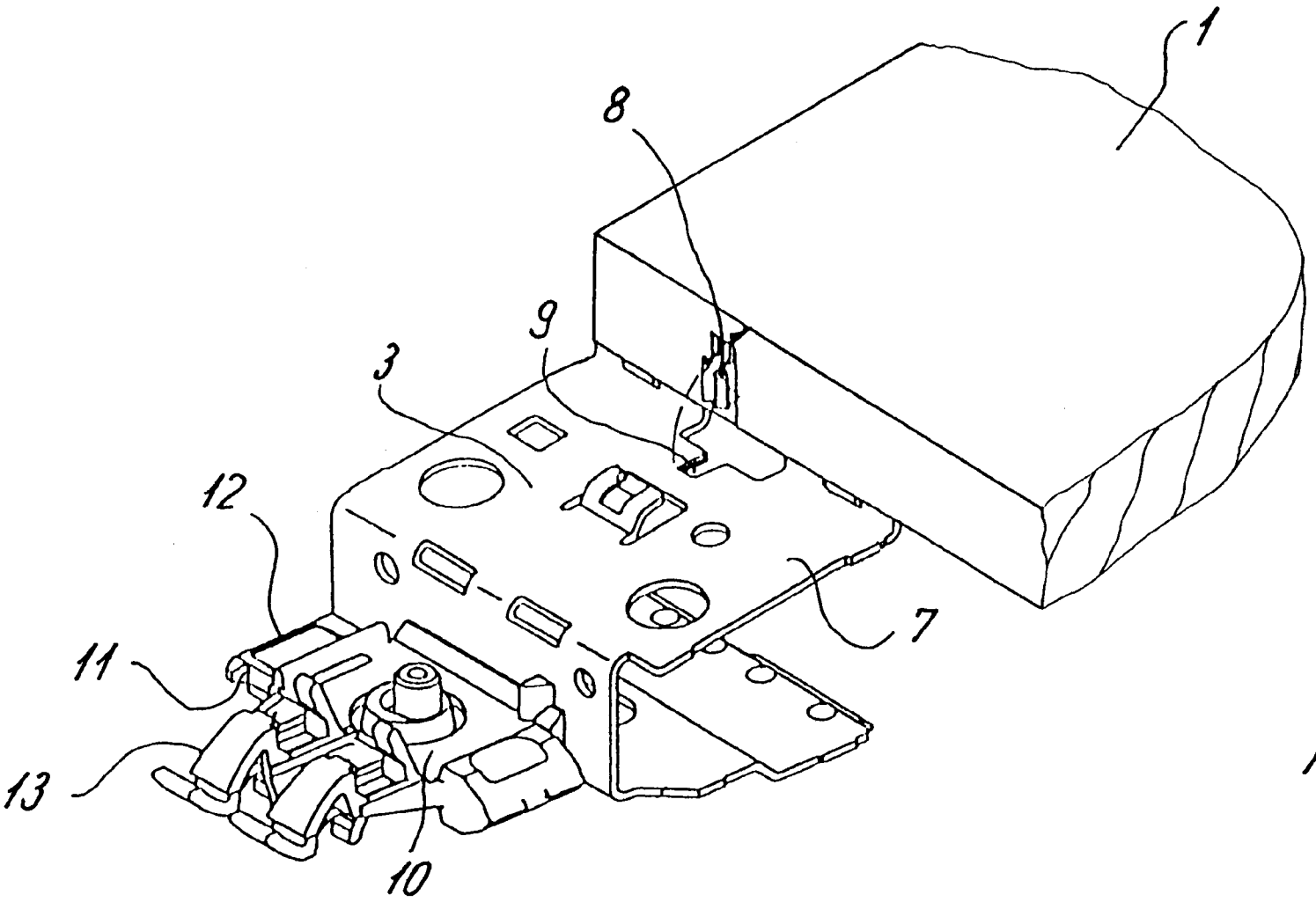
FIG. 3 is an enlarged perspective view of a connection element of the fastening arrangement according to FIG. 1.

The fastening arrangement illustrated in FIGS. 1 to 9 is used for fastening a sliding bottom 1 of a drawer on a furniture body (not shown in detail). For this purpose, connection elements 3, which partially consist of sheet metal, are fastened on both sides of the sliding bottom 1 on one rail of a pull-out slide 2 respectively. Another rail of the pull-out slide can be connected with a side wall of a furniture body. A sheet metal rear-side wall element 4 having a bottom section 5 and a bend 6 is positioned on a rear side of sliding bottom 1. The bottom section front panel 30 can be fixed on the underside of the sliding bottom 1 by fastening elements.

The sliding bottom rests on a horizontally extending bottom section of a connection element 3, on which a pin 8 is pivotally connected. The pin 8 engages a recess formed in the sliding bottom 1 so that the connection element 3 can be stored in a flat condition together with the sliding bottom 1. The pin 8 includes a catch mechanism which engages a recess 9 in a center section 7 of the connection element 3, which is made of a metal sheet.

Figure 5:
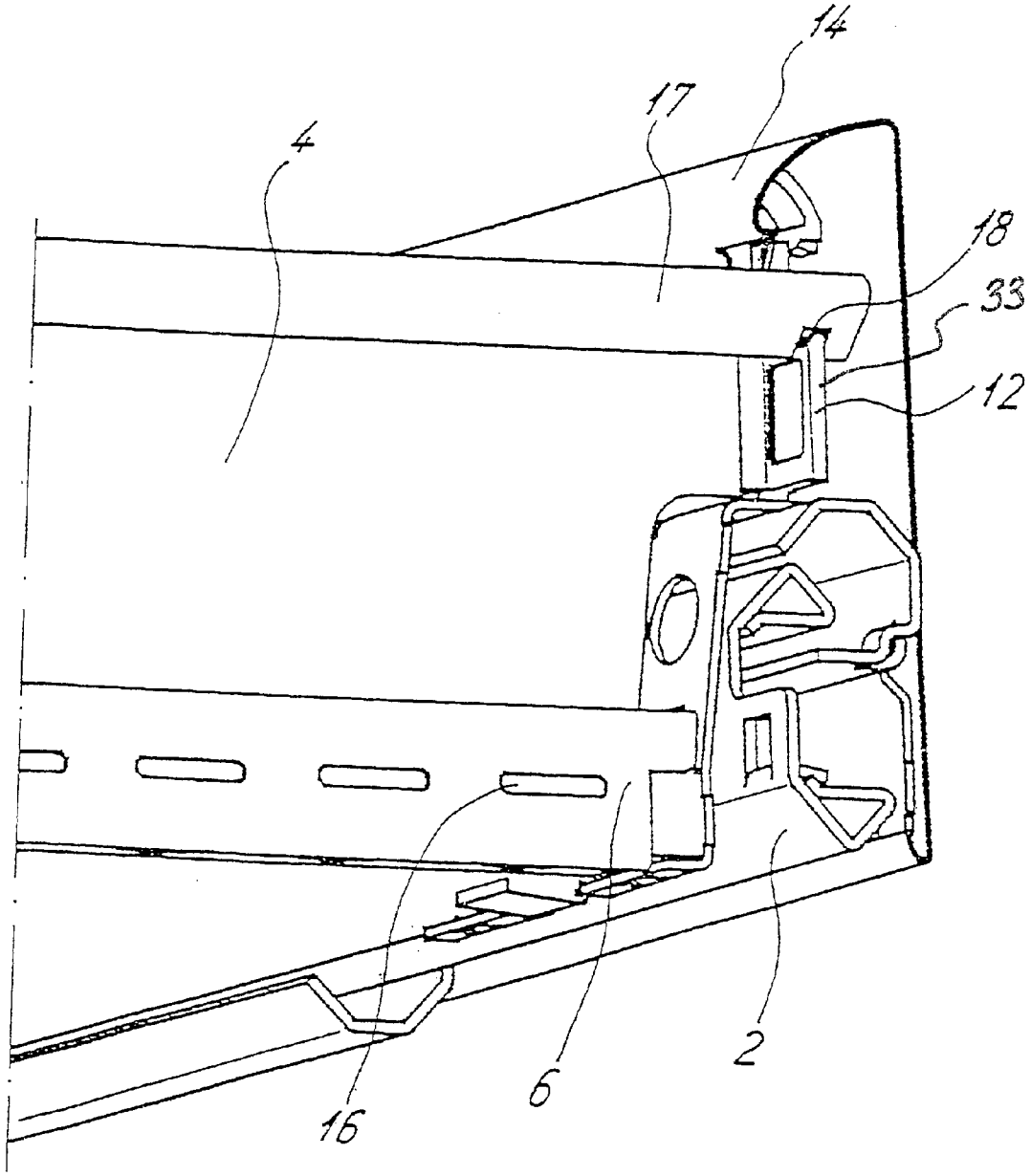
FIG. 5 is a perspective view of the fastening arrangement of FIG. 1 in the mounted condition.
Figure 6:
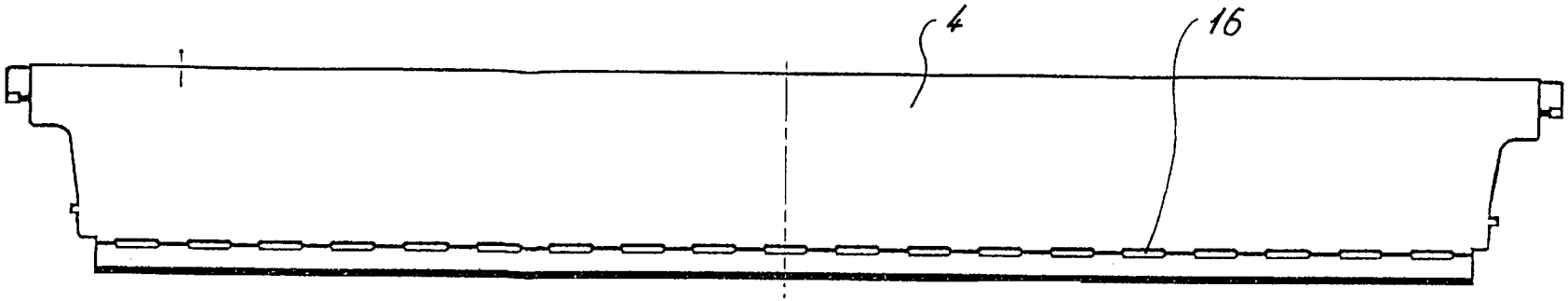
FIG. 6 is a top view of the rear-side wall element of the fastening arrangement according to FIG. 1 in the mounted condition.
Figure 7:
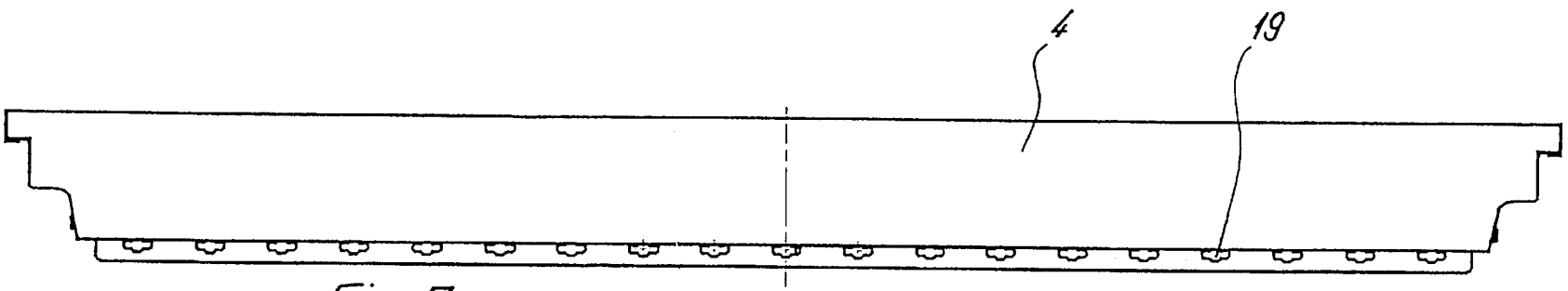
FIG. 7 is a top view of the wall element of the fastening arrangement according to FIG. 1 in the preassembled condition.
Figure 8:
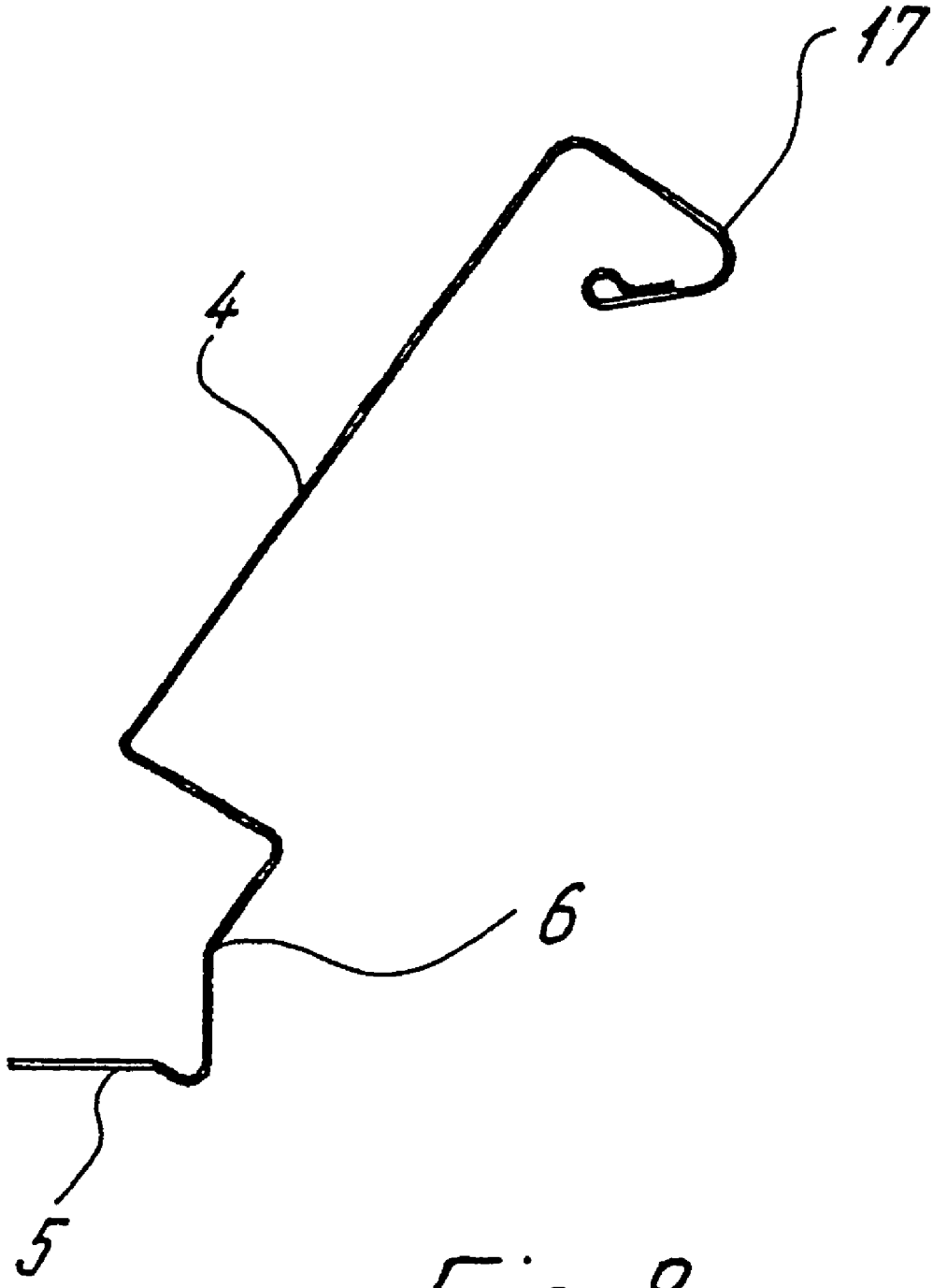
FIG. 8 is a lateral view of the rear-side wall element of the fastening arrangement according to FIG. 1 in the preassembled condition.
Figure 9:
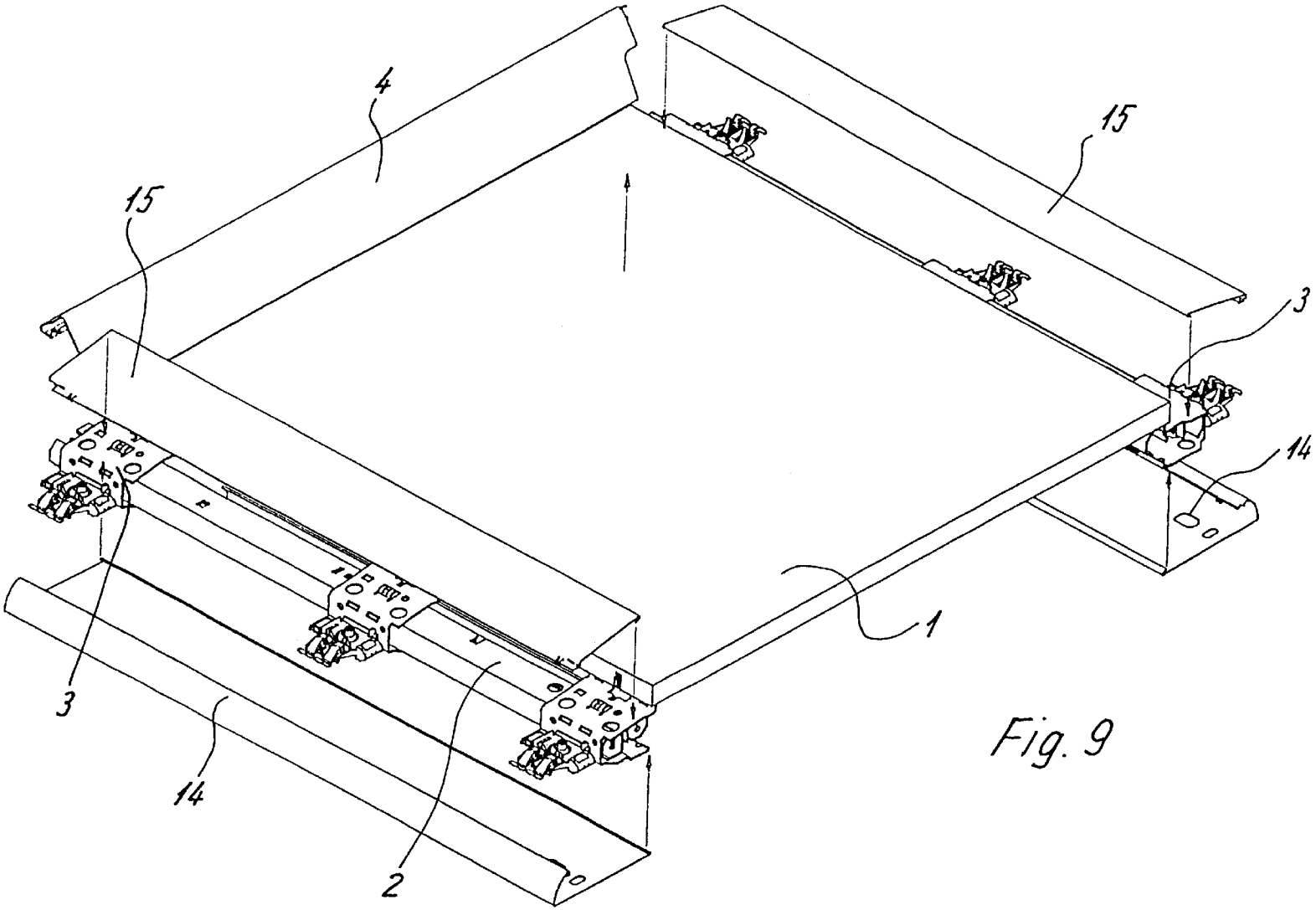
FIG. 9 is a perspective exploded view of the fastening arrangement according to FIG. 1 with side wall elements.

A plastic attachment 10 is molded above the center section 7, which is made of metal, and fastens side wall elements, a front plate or a rear wall. The attachment 10 has a projection 12, recess 11 on an upper edge to form a catch device 33 (FIG. 5). In addition a holding device 13 having several arms is constructed integrally with the attachment 10. The holding device 13 may fasten an additional attachment piece, or may fasten a side wall element.

Figure 4:
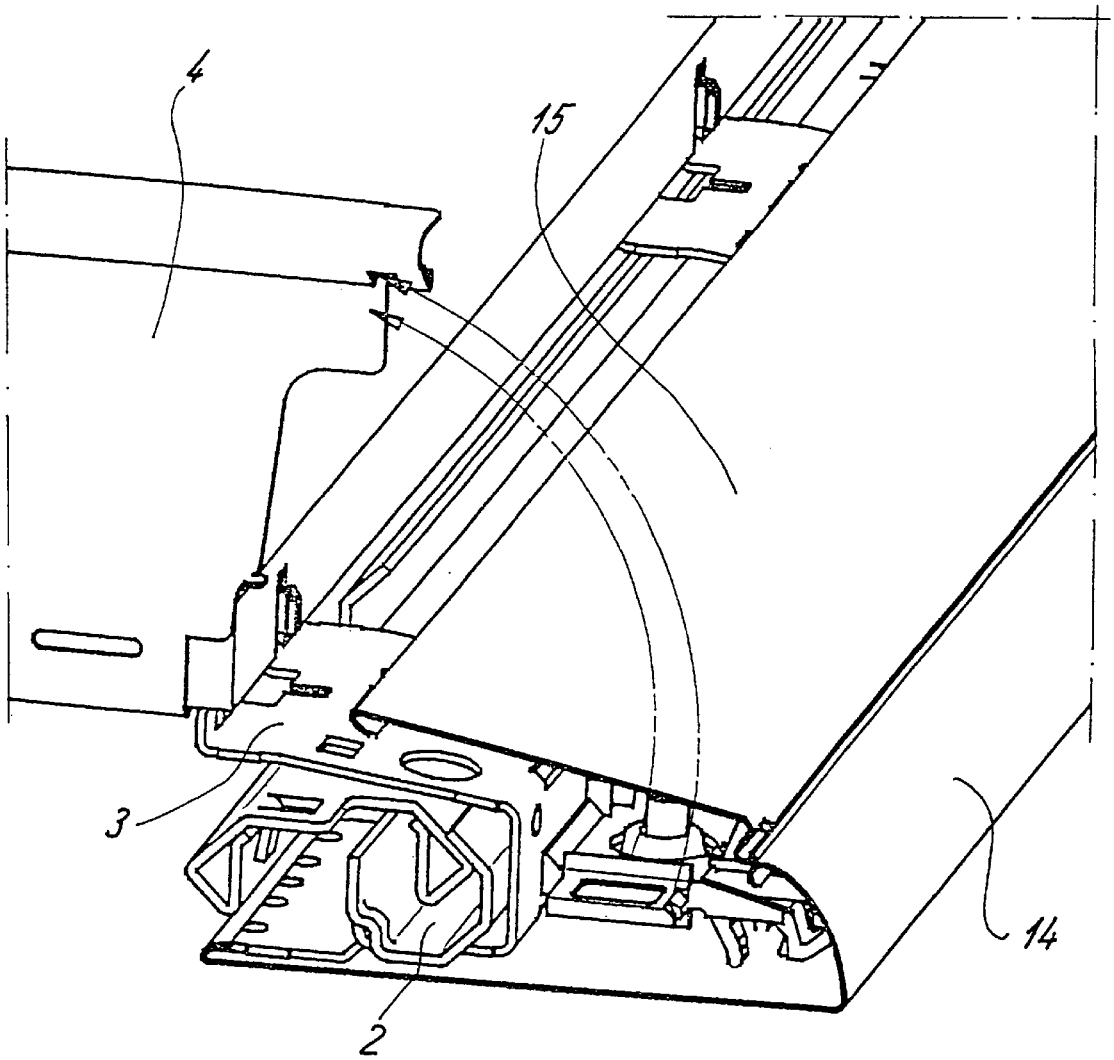
FIG. 4 is a perspective view of the fastening arrangement of FIG. 1 in the preassembled condition.

FIGS. 4 and 5 show the mounting operation of the fastening arrangement. In a preassembled condition, a rearward connection element 3 is fastened on the pull-out slide 2 by a riveted connection. Furthermore, a first side wall element 14 and a second side wall element 15 are fastened on the connection elements 3 along this pull-out slide 2.

First, the wall element 4 is fixed only on the lower side of the sliding bottom 1. For this purpose, keyhole-like openings 19 are constructed in the wall element 4 for receipt of several screws. The opposite upper end of the wall element 4, has a curvature 17. A recess 18 is formed on the curvature 17, just in front of the lateral edge so that the recess or catch opening 18 is formed at the lateral end. The wall element 4 is in the preassembled condition illustrated in FIG. 8.

For the mounting, the rear-side wall element 4 is first bent upward at the bend 6. Oblong openings 16 prevent the wall element 4 from bending at a different point. In addition, the bend 6 rests against the side wall of the sliding bottom 1 so that, during the bending operation, a vertical alignment of the wall element 4 in the area of the bend 6 is promoted.

After the bending-up of the wall element 4 into a mounting position, the side unit with the connection element 3 is pivoted upward into the mounting position until the recess or catch opening 18 engages the recess 11 at the connection element 3. Alternatively, one may first pivot the lateral unit with the connection element 3 upward, then bend the rear-side wall element 4 upward.

Other catch openings may be used, which provide, for example, a snap-type device or other catch elements. In addition, the catch device can be locked by mechanical means to prevent disengagement of the catch device.

Figure 10:
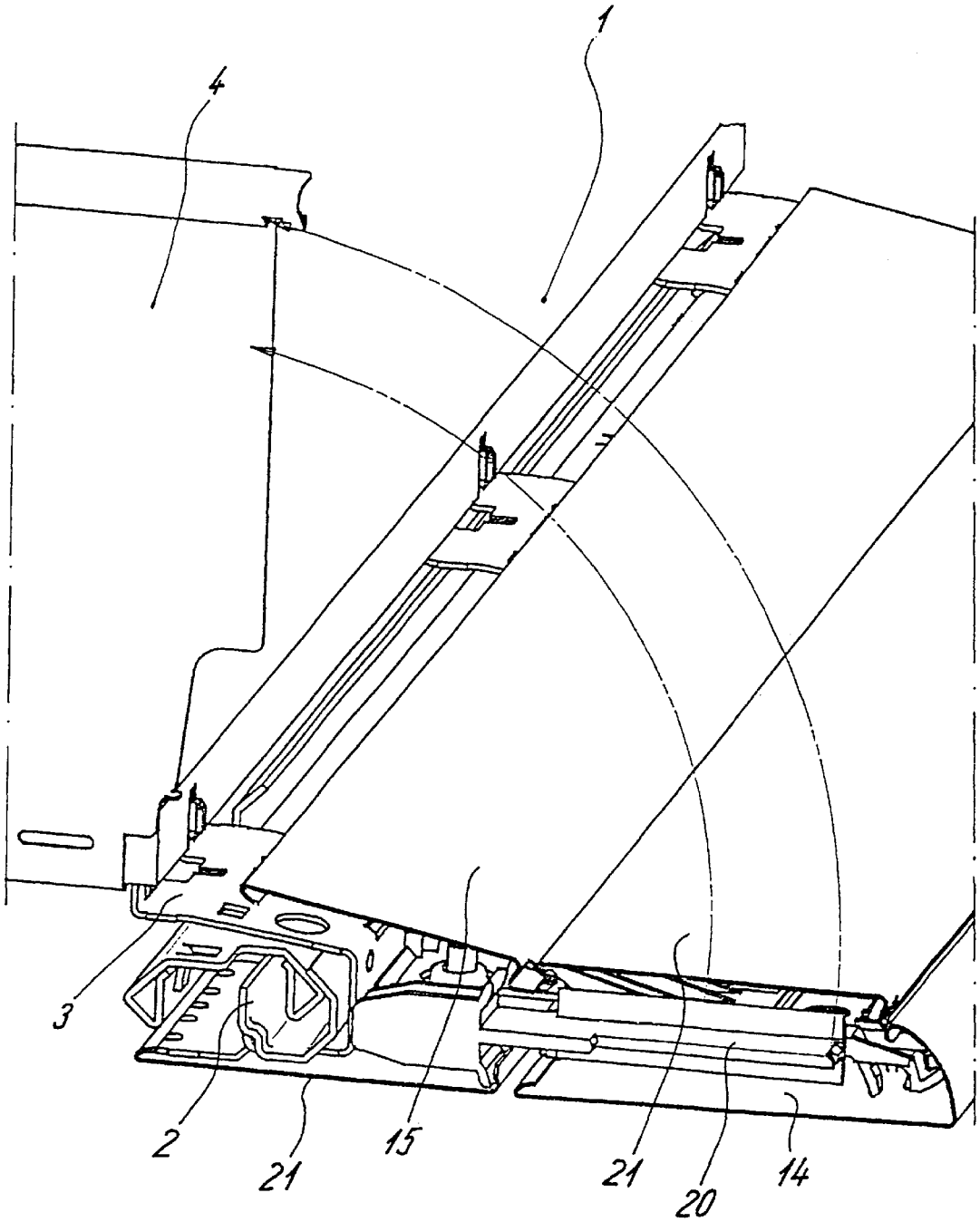
FIG. 10 is a perspective view of a second embodiment of a fastening arrangement according to the invention in the preassembled condition.
Figure 11:
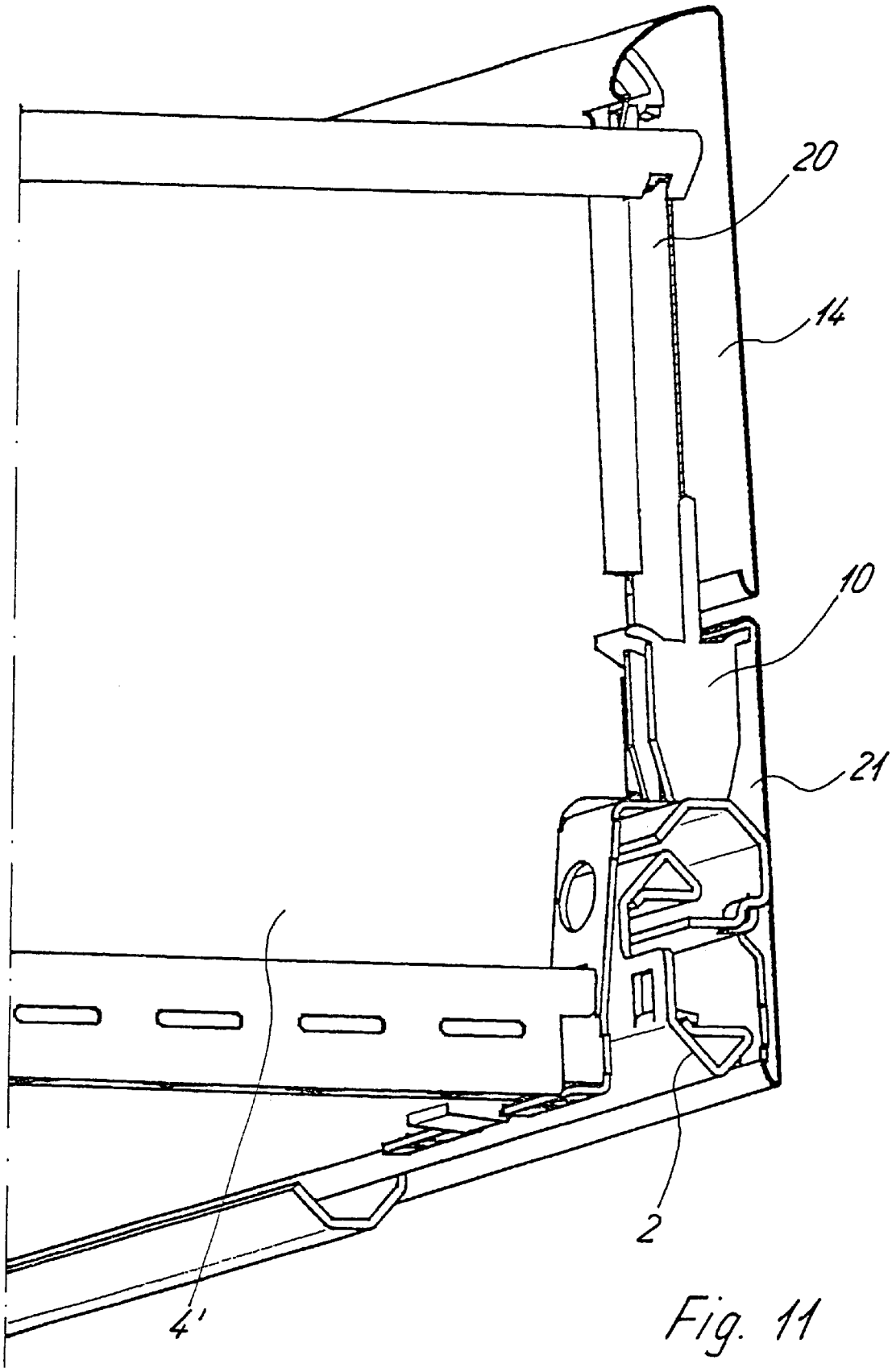
FIG. 11 is a perspective view of the fastening arrangement of FIG. 10 in the mounted condition.

FIGS. 10 and 11 show another embodiment of the fastening arrangement. In this embodiment, another attachment part 20 is mounted on the attachment 10 of the connection element 3. The attachment part 20 engages the holding device 13 and at additional fastening projections. In the upper area, the attachment part 20 is similarly configured as the attachment 10. In particular, a recess is provided which interacts with a catch opening at the rear-side wall element 4'. The attachment part 20 allows the fastening arrangement to be used for a drawer with higher walls. In order to be able to use standard components to the extent possible, the lateral wall elements 14 and 15 can be fastened to the attachment 10 and the attachment part 20. In addition, two identically constructed wall elements 21 are mounted on the attachment and the attachment part 20.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A fastening arrangement for fastening a rear-side wall element of a drawer on a sliding bottom, further comprising:

a rear wall element pivotally connected to the sliding bottom;

a side wall element fixed on the sliding bottom by a connection element mounted on the sliding bottom and adapted for connection to a pull-out slide;

a catch device on the connection element which holds the rear wall element in a mounting position, and an attachment on the connection element, the attachment having a recess and a stop for the wall element.

2. A fastening arrangement according to claim 1, wherein the connection element is pivotally disposed and the catch device engages a part of the rear wall element when in the mounting position.

3. A fastening arrangement according to claim 1, wherein the rear wall element is bendably held on the sliding bottom.

4. A fastening arrangement according to claim 1, further comprising a holding structure on the connection element the holding structure providing a stop for the wall element when in a mounting position.

5. A fastening arrangement according to claim 1, wherein the attachment is made of plastic and is cast onto a section made of metal adapted for connection with a pull-out slide.

6. A fastening arrangement according to claim 5, including a pull-out slide connected with the section made of metal.

7. A fastening arrangement claim 1, the wall element having a bend arranged on a lateral edge of the sliding bottom.

8. A fastening arrangement according to claim 7, further comprising oblong openings are provided adjacent the bend.

9. A fastening arrangement according to claim 1, wherein the rear wall element is pivotally connected to the sliding bottom so as to be repeatedly pivotal.

10. A fastening arrangement for fastening a rear-side wall element of a drawer on a sliding bottom, comprising:

a rear wall element pivotally connected to the sliding bottom;

the wall element having a curvature along its upper edge;

a recess on the curvature forming a catch opening;

a side wall element fixed on the sliding bottom by a connection element mounted on the sliding bottom and adapted for connection to a pull-out slide; and, a catch device on the connection element which holds the rear wall element in a mounting position.

11. A fastening arrangement for fastening a rear-side wall element of a drawer on a sliding bottom, comprising:

a rear wall element pivotally connected to the sliding bottom;

a side wall element fixed on the sliding bottom by a connection element mounted on the sliding bottom and adapted for connection to a pull-out slide; and a catch device on the connection element which holds the rear wall element in a mounting position an attachment on the connection element having a multipart construction and an upper part on which a part of the catch device is provided, and wherein the connection element is pivotally disposed and the catch device engages a part of the rear wall when in the mounting position.

12. A drawer having a sliding bottom held on two sides to pull-out slides by a connection element on each side, respectively, a front panel, side walls, a rear wall element pivotally connected to the sliding bottom, and a catch device on at least one of the connection elements which holds the rear wall element in a mounting position.

* * * * *